United States Patent [19]

Minkkinen

[11] Patent Number: 4,561,965

[45] Date of Patent: Dec. 31, 1985

[54] HEAT AND WATER RECOVERY FROM AQUEOUS WASTE STREAMS

[75] Inventor: Ari A. Minkkinen, Versailles, France

[73] Assignee: Lummus Crest Inc., Bloomfield, N.J.

[21] Appl. No.: 240,734

[22] Filed: Mar. 5, 1981

Related U.S. Application Data

[63] Continuation of Ser. No. 92,908, Nov. 9, 1979, abandoned.

[51] Int. Cl.[4] ..... C10G 1/00

[52] U.S. Cl. ..... 208/11 LE

[58] Field of Search ..... 208/11 LE

[56] References Cited

U.S. PATENT DOCUMENTS

| | | | |
|---|---|---|---|
| 2,772,209 | 11/1956 | Stewart et al. | 208/11 LE |
| 3,208,930 | 9/1965 | Andrassy | 208/11 LE |
| 3,953,318 | 4/1976 | Baillie et al. | 208/11 LE |
| 4,098,674 | 7/1978 | Rammler et al. | 208/11 LE |
| 4,167,470 | 9/1979 | Karnofsky | 208/11 LE |
| 4,240,897 | 12/1980 | Clarke | 208/11 LE |

FOREIGN PATENT DOCUMENTS

| | | | |
|---|---|---|---|
| 614697 | 2/1961 | Canada | 208/11 LE |

*Primary Examiner*—Charles F. Warren
*Assistant Examiner*—Joseph A. Boska
*Attorney, Agent, or Firm*—James N. Blauvelt

[57] ABSTRACT

A hot aqueous waste, containing solids, such as tailings from the hot water extraction of bitumen from tar sands, is contacted with air to increase the heat and moisture content of the air, followed by contacting the heated and moisturized air with water to condense moisture from the air and increase the heat content of the water, with the heated water containing condensed moisture being employed as make-up hot water in the extraction. Water recovery can be further increased by subjecting at least a portion of the tailings, prior to contact with air, to an evaporation procedure wherein heat requirements are provided by indirect heat transfer with steam. Evaporate and condensed steam are employed in the extraction.

1 Claim, 2 Drawing Figures

HEAT AND WATER RECOVERY FROM AQUEOUS WASTE STREAMS

This is a continuation of U.S. application Ser. No. 92,908, filed Nov. 9, 1979, now abandoned.

BACKGROUND OF THE INVENTION

Field of the Invention

This invention relates to recovery of heat and water from aqueous waste streams, and more particularly to improved heat and water recovery in extraction of bitumen from tar sands extraction.

Tar sands (also known as oil sands and bituminous sands) are sand deposits which are impregnated with dense, viscous petroleum. One method for recovering bitumen from such tar sands is the so-called hot water extraction process. In such a process, the tar sand feed is heated and mixed with water to form a pulp, with such pulp being heated by live steam. The pulp is screened and introduced into separation cells which function as two settlers, one on top of the other. The lower settler settles sand down, and the upper settler settles bitumen up: i.e. floats the bitumen. The bulk of the sand in the feed is removed from the bottom of the separation cell as tailings. A major portion of the feed bitumen floats to the surface of the separation cell and is removed as froth. A middlings stream consisting mostly of water, but with some suspended fine mineral and bitumen particles, is the third stream removed from the separation cell. A portion of the middlings may be returned for mixing in the extraction drum in order to dilute the separation cell feed properly for pumping. The balance of the middlings is called the drag stream. Such drag stream is withdrawn from the separation cell to be rejected after processing in the scavenger cells. The drag stream is primarily required as a purge in order to control the fines concentration in the middlings. The drag stream is treated in scavenger cells in order to recover further bitumen. Such scavenging may be accomplished by froth flotation using air, whereby the scavenger froth is combined with the separation cell froth to be further treated and upgraded to synthetic crude oil. Tailings from the scavenger cell are combined with the separation cell tailings stream and go to waste.

The tailings stream from the process contains the bulk of the heat and water that was supplied to meet the process requirements. As a result, such tailings stream represents a heat and water loss.

The present invention is directed to improving heat and water recovery from aqueous waste streams, such as produced in tar sands extraction.

SUMMARY OF THE INVENTION

In accordance with one aspect of the invention, heat and water is recovered from a waste stream of solids in water derived from a process for treating solids with hot water by directly contacting the waste stream with a gas to increase the heat and water content of the gas. The heated and moisturized gas is directly contacted with water to cool the gas and condense moisture therefrom. The heated water, including condensed moisture, is then used as make-up water in the process.

In accordance with a preferred embodiment, heat and water is recovered from the tar sands tailings produced in the hot water extraction of bitumen from tar sands by directly contacting the tar sands tailings with a gas to increase the heat and moisture content of the gas, followed by directly contacting the heated and moisturized gas with water to condense moisture from the gas and increase the heat content of the water, with the heated water containing condensed moisture being employed as make-up hot water in the extraction of bitumen from tar sands. The gas is preferably air; however, it is to be understood that other gases could be employed within the scope of the invention.

In accordance with another aspect of the present invention, water can be recovered from tar sand tailings recovered from the scavenging operation by evaporating water from such tailings, with heat requirements for such evaporation being provided by indirect heat transfer with steam. Steam condensate is recycled to the extraction procedure to provide make-up water therefor. In addition, the water evaporate is passed to the extraction procedure to recover its latent and sensible heat, with such evaporate being condensed in the hot water extraction to provide a portion of the total water requirements therefor.

In accordance with a particularly preferred aspect of the present invention, both schemes for recovering heat and water are incorporated into the tar sands extraction procedure to provide for an improved heat and moisture recovery.

BRIEF DESCRIPTION OF THE DRAWINGS

The invention will be further described with respect to preferred embodiments thereof illustrated in the accompanying drawings, wherein.

It is to be understood, however, that the present invention is not to be limited to the preferred embodiments illustrated in the accompanying drawings.

DESCRIPTION OF THE PREFERRED EMBODIMENTS

Figure 1:
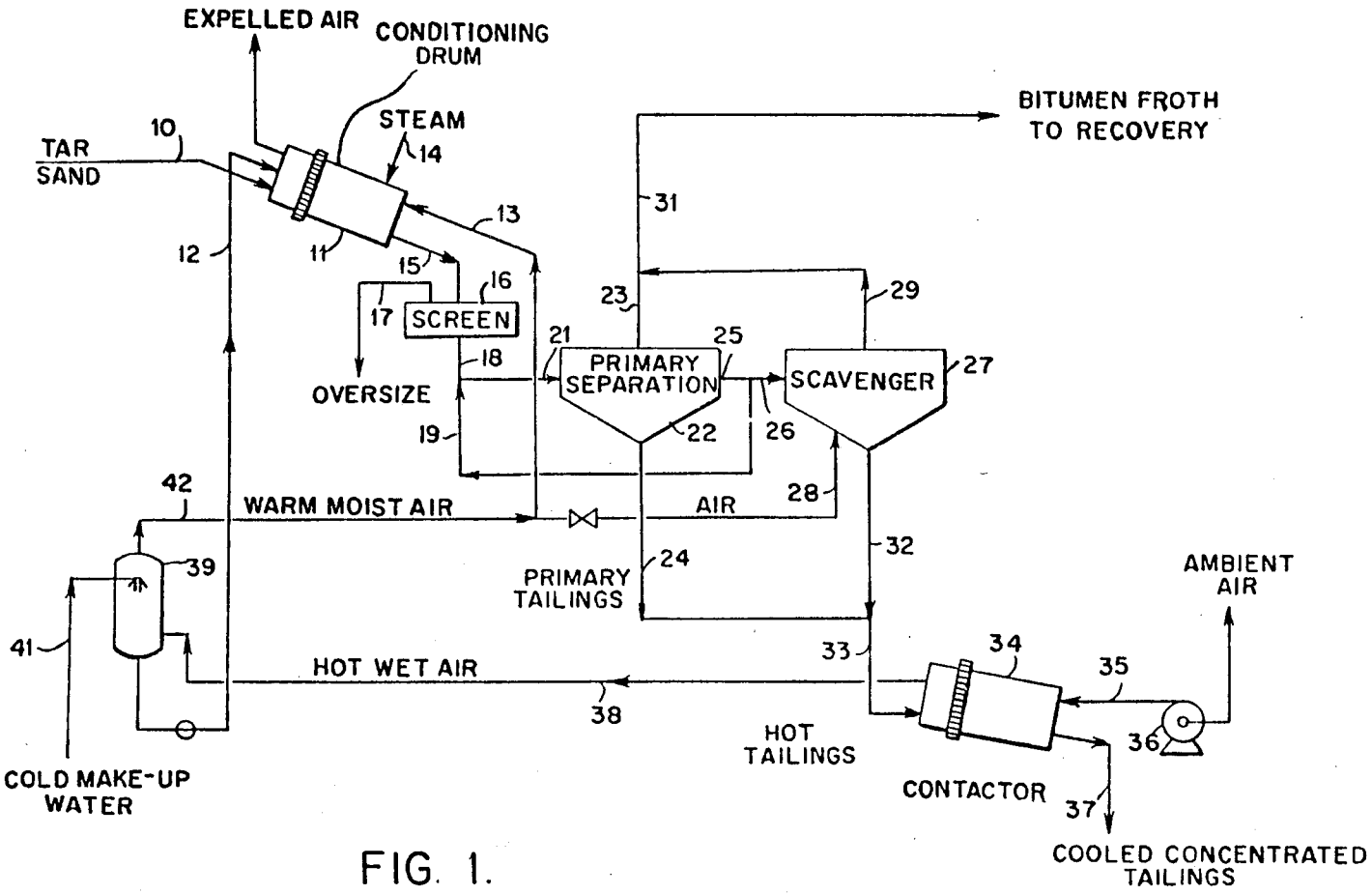
FIG. 1 is a simplified schematic flow diagram of an embodiment of the present invention.

Referring now to FIG. 1 of the drawings, tar sands in line 10 are introduced into a conditioning or extraction drum, schematically generally indicated as 11. The drum is further provided with heated make-up water in line 12, obtained as hereinafter described, and warm moist air, in line 13, obtained as hereinafter described. Additional heat requirements for the conditioning drum are provided by introduction of live steam: for example, 50 psig steam, through line 14.

The conditioning drum 11 is a horizontal rotating drum which is operated at conditions known in the art: for example, a temperature of from 180° to 200° F., to provide a tar sand pulp which generally contains from 60 to 85% solids. In the conditioning drum, as known in the art, the lumps of tar sand, as mined, are reduced in size by ablation, with successive layers of each tar sand lump becoming warm and sloughed off revealing the inner, cooler layers. In addition, the pulp so formed is mechanically mixed, reacted with any chemicals added, and further heated to the processing temperature.

A conditioned effluent is withdrawn from drum 11 through line 15 and introduced into appropriate screening apparatus; schematically indicated generally as 16 to remove tar sand lumps which have not been sufficiently reduced in size. Oversized particles are recovered through line 17. Screen pulp withdrawn through line 18 is combined with a recycle stream in line 19, obtained as hereinafter described, in order to adjust the pulp to the proper consistency for pumping. The combined stream in line 21 is introduced into a primary separation cell, schematically indicated generally as 22, of a type known in the art. As known in the art, the separation cell 22 is operated to recover a major portion of the feed bitumen as a primary froth through line 23, with the bulk of the sand being withdrawn through line 24. A middlings stream is recovered from cell 22 through line 25, and such middling stream comprises mostly water, but also includes suspended fine mineral and bitumen particles. A portion of the middlings stream may be recycled through line 19 to adjust the consistency of the feed to the separation cell 22, as hereinabove described, In practice, the recycle does not generally exceed 15% in that at higher amounts there is a build-up in fines which impedes the separation. The remaining portion of the middlings stream in line 26 may be introduced into a scavenger cell, schematically generally indicated as 27 in order to recover any remaining bitumen, where justified. Such bitumen recovery may be accomplished by froth flotation, using air provided through line 28, obtained as hereinafter described. A scavenger froth withdrawn through line 29 may be combind with the primary froth in line 23, and the combined stream in line 31 further treated and upgraded to synthetic crude oil by procedures known in the art. Sand tailings from the scavenger cell 27 in line 32 are combined with the tailings from the primary separation cell 22 which are in line 24.

Hot tailings from the tar sand extraction procedure in line 33 is introduced into a contacting apparatus, schematically generally indicated as 34, wherein the tailings are countercurrently contacted with a gas introduced through line 35, with the gas, as particularly shown, being ambient air provided through an axial blower, schematically indicated generally as 36. The contactor 34 may be a rotating horizontal drum contactor, which preferably includes internal lifting flights to lift the slurry with the rotation of the drum and create a showering effect for rapid heat and mass transfer with the air introduced through line 35. It is to be understood, however, that other contacting apparatus could be employed within the spirit and scope of the invention. The cold air introduced through line 35 picks up heat and moisture as a result of the countercurrent contact with the hot tailings. Thus, the air introduced through line 35 is employed for the purpose of recovering both heat and water from the hot tailings introduced through line 33.

Cooled and concentrated tailings are withdrawn from contactor 34 through line 37.

In general, the contactor is operated with from 2000 to 5000 SCF of air per ton of tailings, with the hot moist air withdrawn from contactor 34 through line 38 being at a temperature in the order of from 10° F. to 30° F. below the inlet temperature of the slurry. The contacting generally results in a recovery of from about 2% to 10% of the water present in the hot tailings stream in line 33. Thus, for example, ambient air at a temperature of 50° F. and relative humidity of 75% is brought to a pressure of 20 psia and temperature of 60° F. by the axial blower and by contacting a 50% tailings stream the temperature and relative humidity of the air is raised to 170° F. and 78%, respectively.

The hot wet air in line 38 is introduced into a spray cooled condenser, schematically indicated generally as 39 wherein the wet moist air is directly contacted with cold make-up water to the process provided through line 41 with the water generally being at a temperature in the order of from about 40° to about 70° F. As a result of such direct contact, the water is heated and the air is cooled, resulting in water condensation therefrom. If axial blower 36 is operated by a steam turbine, the turbine exhaust may also be introduced into cooler 39 to condense the turbine exhaust and extract its heat content. Thus, for example, make-up water can be heated from an inlet temperature of 50° F. to a temperature of 102° F. and greater.

Heated make-up water, including condensed moisture, withdrawn from condenser 39 through the line 12 is then provided to the conditioning drum 11, as hereinabove described.

Air, which is warm and still contains some moisture, withdrawn from condenser 39 through line 42, may be employed in the conditioning drum 11 through line 13 to effect further heat and moisture recovery therefrom, and a portion thereof may also be employed in line 28 to provide air requirements for the scavenger cell 27.

Thus, in accordance with one aspect of the present invention, heat and water is recovered from tar sands tailings by an indirect process wherein heat and water is initially transferred from the hot tailings stream to a cooler gas, in particular ambient air, with the heat primarily being transferred in the form of latent heat. Subsequently, latent heat and sensible heat, as well as water, is recovered from the gas by the use of cold make-up process water as a "spray" coolant. In this manner, there is a reduction in the quantity of process steam required to heat the conditioning drum, and in addition, less make-up water is required to supply the total process water demand because a portion of the water which is normally rejected in the tailings stream is recovered for recycle to the process.

Figure 2:
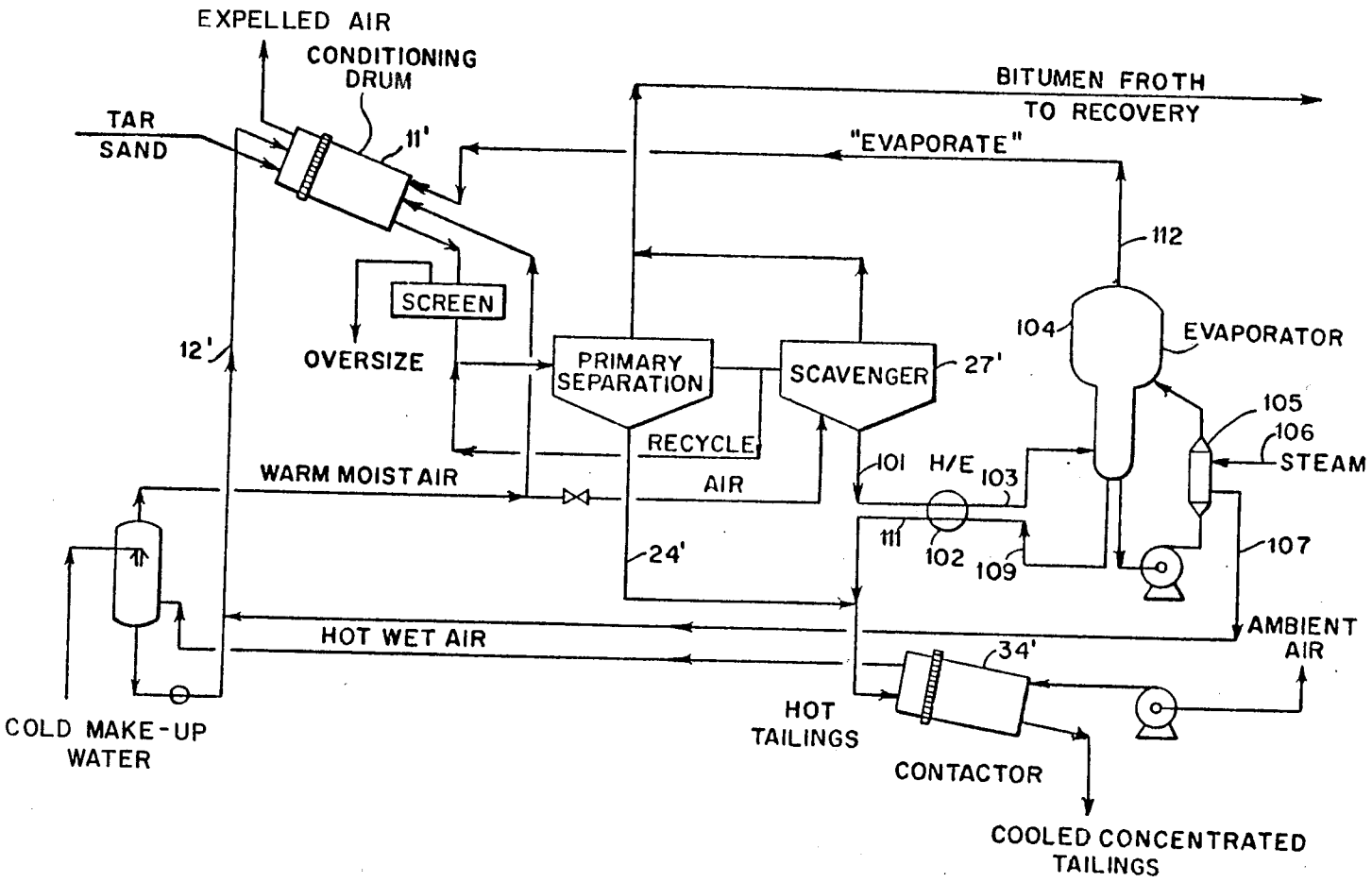
FIG. 2 is a simplified schematic flow diagram of a modification of the embodiment of FIG. 1.

A modification of the embodiment of FIG. 1 is illustrated in FIG. 2, wherein like parts are designated by like prime numerals. The embodiment of FIG. 2 differs from the embodiment of FIG. 1 basically with respect to recovery of heat and water from the tailings recovered from the scavenger cell, prior to recovery of heat and water therefrom by indirect transfer by the use of a gas, as hereinabove described with respect to FIG. 1. In describing the embodiment of FIG. 2, such description will be directed to the portions thereof which differ from the embodiment of FIG. 1.

Referring now to FIG. 2 of the drawings, tailings from scavenger cell 27' in line 101 is heated in heat exchanger 102 by indirect heat transfer, as hereinafter described, with the heated stream in line 103 being introduced into an evaporator, schematically indicated generally as 104. The exchanger 102 may be a shell and tube type of exchanger in that the scavenger tailings do not contain coarse sand; i.e., the sand is present as fines. The evaporator 104 is preferably of the forced circulation type, and operates at a slight positive pressure; e.g., 5 psig. The evaporator is operated in a manner such that water is evaporated from the tailings to effect concentration thereof, with the heat requirements for such evaporation being provided by circulating a portion of the material to be evaporated through a heat exchanger, schematically generally indicated as 105 wherein the material to be evaporated is indirectly heated by introduction of live steam; for example, 50 psig steam through line 106. Steam condensate is withdrawn from heat exchanger 105 through line 107 and such steam condensate is combined with heated water in line 12' for introduction into the conditioning drum 11'. In this manner, after providing heat requirements for generation of clean recycle water, the steam augments the make-up water to the conditioning drum 11'.

Concentrated tailings are withdrawn from evaporator 104 through line 109 and passed through heat exchanger 102 for heating the tailings stream in line 101. The cooled concentrate in line 111 is combined with the primary tailings in line 24' for introduction into the contactor 34' for recovering heat and water, as hereinabove described with reference to the embodiment of FIG. 1. The evaporate withdrawn from evaporator 104 through line 112 is introduced into the conditioning drum 11' wherein latent and sensible heat are recovered therefrom. In addition, the evaporate is condensed in conditioning drum 11' to provide a portion of the water requirements for the conditioning of tar sand. In this manner, water which would normally be discarded in a waste stream as a result of the great difficulty in separating fines, is recovered as clean recycle; i.e., free of suspended fine particles.

Thus, in accordance with the embodiment of FIG. 2, additional heat and water are recovered by indirect use of steam; i.e., the steam is employed to provide heat requirements for an evaporation, rather then direct introduction of such steam into the conditioning drum.

It is to be understood that although the evaporation scheme of the embodiment of FIG. 2 is preferably employed in combination with the water and heat recovery scheme particularly described with respect to the embodiment of FIG. 1, it is also possible to employ such an evaporation scheme with the heat and water recovery described with reference to the embodiment of FIG. 1.

The hereinabove described embodiments may be modified within the spirit and scope of the present invention, and as a result, the invention is not limited to such embodiments. Thus, for example, although the use of air as the gas for recovering heat and moisture is preferred, it is possible to use a gas other than air as long as such gas does not adversely affect the conditioning operation. Similarly, the embodiments are not to be limited to the particular type of equipment described with respect to such embodiments in that it is possible to use other equipment within the spirit and scope of the invention.

Although the invention has particular applicability to the recovery of heat and moisture from a tar sands tailings stream, it is to be understood that the overall process may be employed for recovering heat and moisture from other types of slurry streams.

It is also to be understood that in effecting recycle of process water to the conditioning drum, it is possible to directly employ a portion of the hot tailings stream as a recycle in order to provide a portion of the water requirements, as known in the art; however, in general, such hot tailings cannot be tolerated in excess of about 15% of the total water required for conditioning.

The invention will be further described with respect to the following example; however, the scope of the invention is not to be limited thereby.

EXAMPLE

The following Table 1 compares the conventional hot process water scheme (Case I) with an embodiment of the invention which employs only the evaporation of the tailings from the scavenger call (scheme 2); the embodiment of FIG. 1 (scheme 3); and the embodiment of FIG. 2, which includes evaporation and heat exchange with air (scheme 4). The tabulation is based on 100,000 Barrels per stream day bitumen production.

TABLE I

BASIS: 100,000 BPSD BITUMEN PRODUCTION

| CASE DESCRIPTION | I CONVENTIONAL SCHEME | II CONV + EVAP | III FIG. 1 | IV FIG. 2 |
|---|---|---|---|---|
| PROCESS WATER SOURCE | IN 1000 LBS/HR | | | |
| RECYCLE (15%) | 2625 | 2625 | 2625 | 2625 |
| PROC. STEAM | 2812 | — | 2151 | — |
| STEAM COND. | — | 2805 | 180 | 2270 |
| EVAPORATE | — | 2109 | 880 | 2538 |
| MAKE UP | 12063 | 9961 | 11664 | 10067 |
| TOTAL | 17500 | 17500 | 17500 | 17500 |
| PROCESS STEAM TO | IN 1000 LBS/HR | | | |
| CONDITIONING | 2812 | — | 2151 | — |
| EVAPORATOR | — | 2805 | — | 2090 |
| HEAT RECOVERY | — | — | 180 | 180 |
| TOTAL | 2812 | 2805 | 2331 | 2270 |
| MAKE UP WATER TO | IN 1000 LBS/HR | | | |
| CONDITIONING | 12063 | 9961 | 11664 | 10067 |
| BOILER PLANT | 2812 | 2805 | 2331 | 2270 |
| TOTAL | 14875 | 12766 | 13995 | 12337 |

The present invention is particularly advantageous in that it permits both heat and water recovery from the tailings stream produced in a tar sands extraction process. The overall economics of the process is improved as a result of increased recovery of both heat and water values.

These and other advantages should be apparent to those skilled in the art from the teachings herein.

Numerous modifications and variations of the present invention are possible in light of the above teachings and, therefore, within the scope of the appended claims, the invention may be practiced otherwise than as particularly described.

I claim:

1. In a process for the hot-water extraction of bitumen from tar sands wherein the tar sands are conditioned with hot water; the water-conditioned sands are treated in a primary separation zone to recover a bitumen stream, a middling stream, and a primary tar sands tailing stream; and the middling stream is treated in a scavenger separation zone to recover another bitumen stream and a scavenger tar sands tailing stream, the improvement comprising contacting a waste stream comprising the primary tar sands tailing stream and the scavenger tar sands tailing stream with air to as to increase the heat and moisture content of the air, said air being employed in an amount of from 2000 to 5000 SCF per ton of tar sands tailings sufficient to recover from 2% to 10% of the water present in the hot tar sands tailings; directly contacting water with the heated and moisturized air to condense moisture from the air and to increase the heat content of the water, said water contacting said air as a spray coolant; and employing the heated water containing condensed moisture as make-up hot water in the process.

* * * * *